US009707762B2

(12) United States Patent
Brewster et al.

(10) Patent No.: US 9,707,762 B2
(45) Date of Patent: Jul. 18, 2017

(54) PRINTHEAD CLEANING CAP

(71) Applicant: Tonejent Limited, Royston, Hertfordshire (GB)

(72) Inventors: Alan Charles Brewster, Royston (GB); Ian Philip Butler Ingham, Royston (GB); Richard Paine, Royston (GB); Elliott Major Smart, Royston (GB); Jerzy Marcin Zaba, Royston (GB)

(73) Assignee: Tonejet Limited, Royston, Hertfordshire (GB)

( * ) Notice: Subject to any disclaimer, the term of this patent is extended or adjusted under 35 U.S.C. 154(b) by 0 days.

(21) Appl. No.: 15/022,468

(22) PCT Filed: Sep. 24, 2014

(86) PCT No.: PCT/EP2014/070372

§ 371 (c)(1),
(2) Date: Mar. 16, 2016

(87) PCT Pub. No.: WO2015/044202

PCT Pub. Date: Apr. 2, 2015

(65) Prior Publication Data

US 2016/0221343 A1 Aug. 4, 2016

(30) Foreign Application Priority Data

Sep. 25, 2013 (EP) ..... 13185952

(51) Int. Cl.
*B41J 2/165* (2006.01)

(52) U.S. Cl.
CPC ..... *B41J 2/16505* (2013.01); *B41J 2/16552* (2013.01); *B41J 2002/16529* (2013.01); *B41J 2002/16558* (2013.01)

(58) Field of Classification Search
CPC B41J 2/16538; B41J 2/16552; B41J 2/16532; B41J 2/16505; B41J 2/1652;
(Continued)

(56) References Cited

U.S. PATENT DOCUMENTS 6,132,026 A 10/2000 Taylor et al.
6,217,154 B1 4/2001 Newcombe et al.
(Continued)

FOREIGN PATENT DOCUMENTS

CN 1209773 A 3/1999
EP 1 016 528 A1 7/2000
(Continued)

OTHER PUBLICATIONS

International Search Report dated Feb. 11, 2015, issued in PCT Application No. PCT/EP2014/070372.
(Continued)

*Primary Examiner* — Thinh H Nguyen
(74) *Attorney, Agent, or Firm* — Dickinson Wright PLLC

(57) ABSTRACT

A printhead maintenance cap for attachment to a printhead, the cap comprising: a main body defining a chamber into which rinse fluid passes from the printhead during a cleaning cycle; a seal for engagement with the printhead prior to a cleaning cycle starting; and a venting system for equalizing the pressure in the chamber and the surrounding atmosphere.

14 Claims, 9 Drawing Sheets

(58) Field of Classification Search
CPC ..... B41J 2/16523; B41J 2/16535; B41J 2002/16529; B41J 2002/16558
See application file for complete search history.

(56) References Cited

U.S. PATENT DOCUMENTS

| | | | | |
|---|---|---|---|---|
| 6,497,471 | B1 | 12/2002 | Gargir | |
| 8,167,395 | B2 * | 5/2012 | Fienup | B29C 67/0059 347/14 |
| 2006/0061618 | A1 | 3/2006 | Hernandez et al. | |
| 2011/0227998 | A1 | 9/2011 | Kamiyama | |

FOREIGN PATENT DOCUMENTS

| | | |
|---|---|---|
| EP | 1 018 430 A1 | 7/2000 |
| WO | WO 93/11866 | 6/1993 |
| WO | WO 97/27056 | 7/1997 |
| WO | WO 97/27058 | 7/1997 |
| WO | WO 98/32609 | 7/1998 |
| WO | WO 98/42515 | 10/1998 |
| WO | WO 01/30576 | 5/2001 |
| WO | WO 03/101741 | 11/2003 |

OTHER PUBLICATIONS

Chinese Office Action dated Oct. 26, 2016 which issued in a corresponding Patent Application No. 201480052552.5.

* cited by examiner

Figure 3 Sectional view in XZ of cleaning fluid manifold
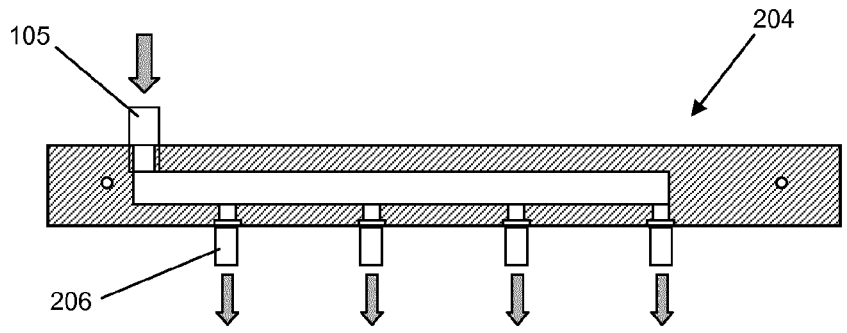
Figure 4 Sectional view in YZ of printhead
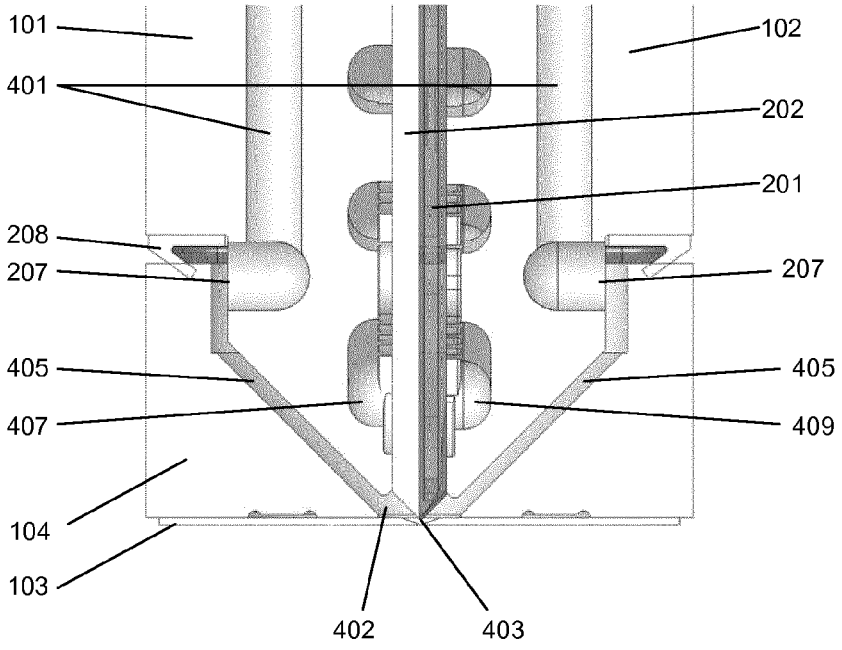

PRINTHEAD CLEANING CAP

FIELD OF THE INVENTION

The present invention relates to a printhead maintenance cap for use with an electrostatic printhead.

BACKGROUND

The general method of operation of the type of printhead described in WO 93/11866 is well known, wherein an agglomeration or concentration of particles is achieved in the printhead, and, at the ejection location, the agglomeration of particles is then ejected on to a substrate. In the case of an array printer, plural ejection locations may be arranged in one or more rows.

Electrostatic printers of this type eject charged solid particles dispersed in a chemically inert, insulating carrier fluid by using an applied electric field to first concentrate and then eject the solid particles. Concentration occurs because the applied electric field causes electrophoresis and the charged particles move in the electric field towards the substrate until they encounter the surface of the ink. Ejection occurs when the applied electric field creates an electrophoretic force that is large enough to overcome the surface tension. The electric field is generated by creating a potential difference between the ejection location and the substrate; this is achieved by applying voltages to electrodes at and/or surrounding the ejection location.

The location from which ejection occurs is determined by the printhead geometry and the location and shape of the electrodes that create the electric field. Typically, a printhead consists of one or more protrusions from the body of the printhead and these protrusions (also known as ejection upstands) have electrodes on their surface. The polarity of the bias applied to the electrodes is the same as the polarity of the charged particle so that the direction of the electrophoretic force is away from the electrodes and towards the substrate. Further, the overall geometry of the printhead structure and the position of the electrodes are designed such that concentration and then ejection occurs at a highly localised region around the tip of the protrusions.

The ink is arranged to flow past the ejection location continuously in order to replenish the particles that have been ejected. To enable this flow the ink must be of a low viscosity, typically a few centipoises. The material that is ejected is more viscous because of the higher concentration of particles due to selective ejection of the charged particles; as a result, the technology can be used to print onto non-absorbing substrates because the material will not spread significantly upon impact.

Various printhead designs have been described in the prior art, such as those in WO 93/11866, WO 97/27058, WO 97/27056, WO 98/32609, WO 98/42515, WO 01/30576 and WO 03/101741.

In use, printheads will, at some stage, require cleaning for one or more of various reasons including removing agglomerations of ink particles from the ejection tips of the printhead or removing airborne particles from the ejection tips or intermediate electrode (IE). All previous printheads and cleaning methods were such that the cleaning was carried out by replacing all of the ink within the printhead with rinse fluid.

Such a design and process that involves replacing the ink within the printhead with rinse fluid leads to various problems. Firstly, cleaning the printhead by flushing through the ink path with rinse fluid creates a large amount of ink-rinse mixture which dilutes the ink and/or contaminates the rinse which must be filtered or discarded. It also requires the printhead to be re-primed with ink after cleaning, requiring significant time for the ink concentration to stabilise as the rinse is replaced with ink. This further causes dilution of the ink and/or mixing of a quantity of ink into the rinse, which has to be filtered out to clean the rinse.

Additionally, such a process is time consuming and, in particular when it is desired to carry out cleaning periodically to keep ejectors and intermediate electrode suitably clean to maintain good print performance for the printhead, it is desired to minimise the downtime of the printhead.

Thus the present invention is directed to reducing or avoiding entirely one or more of the problems identified above.

It has been recognised that cleaning of the ejection tips and if provided the intermediate electrode is usually sufficient to maintain print performance, and that other structures within the printhead do not require regular cleaning in operation.

According to the present invention, there is provided a method of cleaning an electrostatic printhead which has one or more ejection tips from which, in use, ink is ejected, the method comprising stopping a prior flow of ink to a region around the ejection tip(s) for, in use, printing, causing a pressure differential to occur at the tip region thereby causing the ink meniscus to retreat from the tip, and passing a rinse into the tip region to clean the tip.

Such method allows the tips to be free, or substantially free, of ink when the rinse is supplied. This ensures that the amount of ink wasted and/or rinse fluid that is required is minimised, as there are fewer regions through or across which the rinse is flowed and these regions are not filled with ink when the rinse is supplied.

One advantage of the invention is that the printhead is kept primed with ink during cleaning. Preferably, dedicated passages in the printhead direct rinse fluid and air to the tip-IE (intermediate electrode) cavity of the printhead, which is cleaned with very little mixing of rinse with ink. Ink flow around the tips is preferably stopped but the printhead remains full of ink. Air pressure in the tip region is preferably raised so that the ink meniscus retreats slightly from the tip region, exposing the tips for cleaning. Rinse may then be directed at the inside faces of the IEs from the dedicated passages within the printhead body, resulting in the cleaning of the inside face of the IEs and the tips. Rinse flow is preferably pulsed in short bursts, which helps to reduce the amount of rinse that enters the ink channels. The rinse preferably then drains into a maintenance cap sealed onto the face of the printhead during maintenance.

By using separate passages to introduce cleaning fluids to the printhead tips and IE, and by withdrawing the ink from the tips but not from the rest of the printhead, prime is maintained and cross-contamination of rinse and ink is minimised; by pulsing the flow of rinse into the printhead, alternating with air, the rinse does not flow up the ink channels significantly; by making repriming unnecessary the cleaning cycle is dramatically shortened and waste is reduced.

The ink preferably remains in the body of the printhead during the cleaning of the tips. This means that re-priming of the printhead after cleaning is therefore faster, as the ink only needs to be moved forward towards the tips rather than refilling the entire printhead. The "body of the printhead" essentially means the parts of the printhead of significant volume which would, in the normal course of operation contain ink. This includes the inlet and outlet manifolds, and typically it means that there is still ink at the base of the ink channels which connect to the respective ejection tips.

The method may further comprise the step of pulsing the flow of rinse. The pulsing may include alternating pulses of rinse and air. The pulsing may comprise pulses of air and rinse combined. The pulsing may comprise injecting rinse into an airflow. The pulsing may include air pulses, and pulses of air and rinse combined.

The air/rinse pulse is preferably 50% longer than the air pulse. The air/rinse pulse is typically 3 seconds. The air pulse is typically 2 seconds.

The printhead preferably comprises an intermediate electrode and the rinse is preferably directed at an inside face of the intermediate electrode.

The pressure differential required is preferably formed between the ink in the body of the printhead, and the atmosphere at the tip.

The pressure differential may be caused by applying a localised increase in atmospheric pressure at the tip.

The increase in atmospheric pressure at the tip may be caused by flowing air and/or rinse into the tip region.

The pressure differential may be caused by reducing the ink pressure in the body of the printhead.

The present invention also provides an electrostatic printhead comprising a main body including an inlet for ink, an array of one of more ejection tips from which in use ink can be ejected from the main body, respective channels through the main body for supplying ink to, and taking ink away from, the tips, and at least one dedicated passage extending through the main body to the ejection tips for the supply of a rinse fluid to clean the tips.

The printhead may include a datum plate having a cavity that surrounds the ejection tips, wherein the cavity is v-shaped.

The main body may also include an inflow and outflow block through which ink passes.

The angle of the "V" preferably matches a corresponding feature on the inflow and outflow block, thereby defining one or more parallel-sided fluid pathways.

A seal may be provided between the datum plate and the inflow and outflow block.

Also provided is a maintenance cap which can provide one of more of the following advantages: (i) catch and drain rinse fluid expelled from the printhead, (ii) assist in cleaning the front face of the printhead, (iii) allow the printhead to remain filled with ink during cleaning of the tips and IE, and (iv) cannot be inserted or withdrawn erroneously while clamped to the printhead.

According to the present invention, there is provided a printhead maintenance cap for attachment to a printhead, the cap comprising: a main body defining a chamber into which rinse fluid passes from the printhead during a cleaning cycle; a seal for engagement with the printhead prior to a cleaning cycle starting; and a venting system for equalising the pressure in the chamber and the surrounding atmosphere.

The printhead to which the maintenance cap is attached, in use, is may be an electrostatic printhead. The terms "maintenance cap" and "cleaning cap" are synonymous. Whilst cleaning is the preferred purpose for the cap, other tasks are also envisaged The printhead maintenance cap may further comprise means for, in use, bringing the seal into engagement with the printhead. The engagement means includes a clamp and/or a pneumatically operated mechanism.

The venting system may include one or more baffles. The one or more baffles may be formed from a single piece component formed by stereolithography or a three-dimensional printing technique.

The printhead maintenance cap may further comprise one or more drains for draining fluid from the cap in use. This has particular benefit as it allows the cap to be used in a range of orientations, especially when more than one drain is provided.

One or more additional seals may be provided to permit the cap to be used with a multi-head printhead.

The printhead maintenance cap may further comprise a movable spray head for providing one or more jets of rinse fluid within the cap.

A drive mechanism for moving the cap into and out of engagement with the printhead may be provided. This may be part of the engagement means of the printhead maintenance cap or may be separate.

The printhead maintenance cap may further comprise an interlock for preventing movement of the cap when in a sealed engagement with the printhead.

The printhead maintenance cap may further comprise a vacuum wiper. The vacuum wiper may be pivotable relative to the cap main body. The vacuum wiper may be biased towards the intended location of the printhead.

The invention also provides an electrostatic printhead having a plurality of ejection tips and an intermediate electrode, the printhead further comprising a maintenance cap as described above.

In the printhead, the vacuum wiper preferably does not contact the intermediate electrode.

Previous maintenance caps:

- were not vented so draining fluid out of the maintenance cap could draw fluid out of the printhead or de-prime the printhead, necessitating prior removal of ink from the printhead.
- did not seal to the intermediate electrode, but to the printhead casework which would therefore become wet internally during cleaning and necessitate a prolonged drying period.
- had no protection against erroneous insertion or withdrawal of the unit while in the clamped state.

DESCRIPTION OF THE DRAWINGS

Various embodiments of the invention will now be described with reference to the attached figures in which:

FIG. 3 is a sectional view of a manifold block that directs cleaning fluids to different parts of the printhead;

FIG. 4 is a sectional view in of the printhead showing the passages that direct cleaning fluids to the tip region of the printhead;

DESCRIPTION OF THE PREFERRED EMBODIMENT

Figure 1:
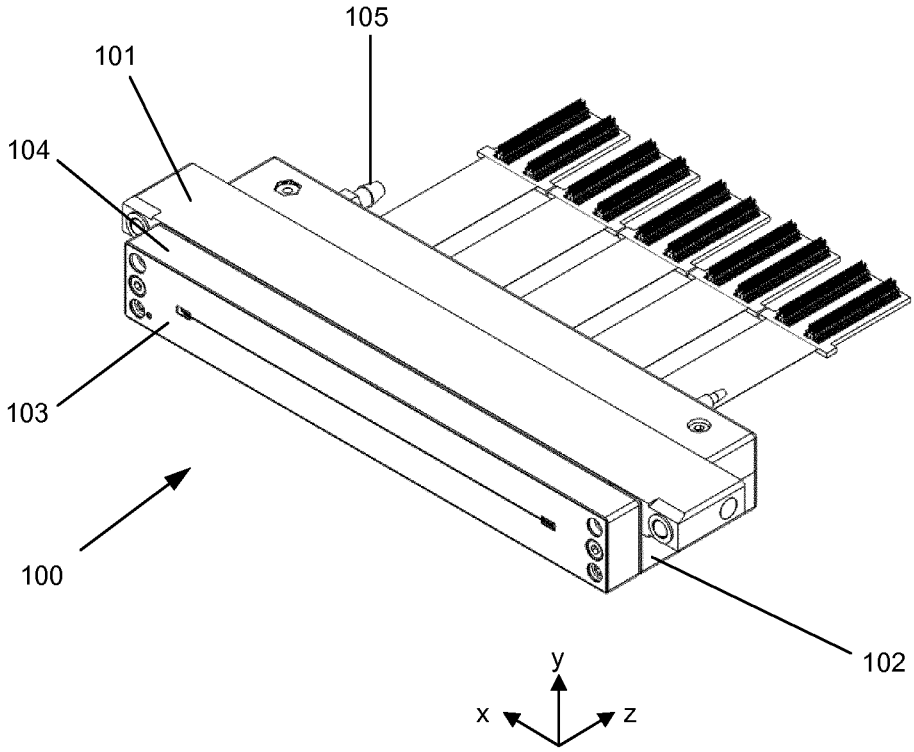
FIG. 1 is a perspective view of a printhead according to the present invention.
Figure 2:
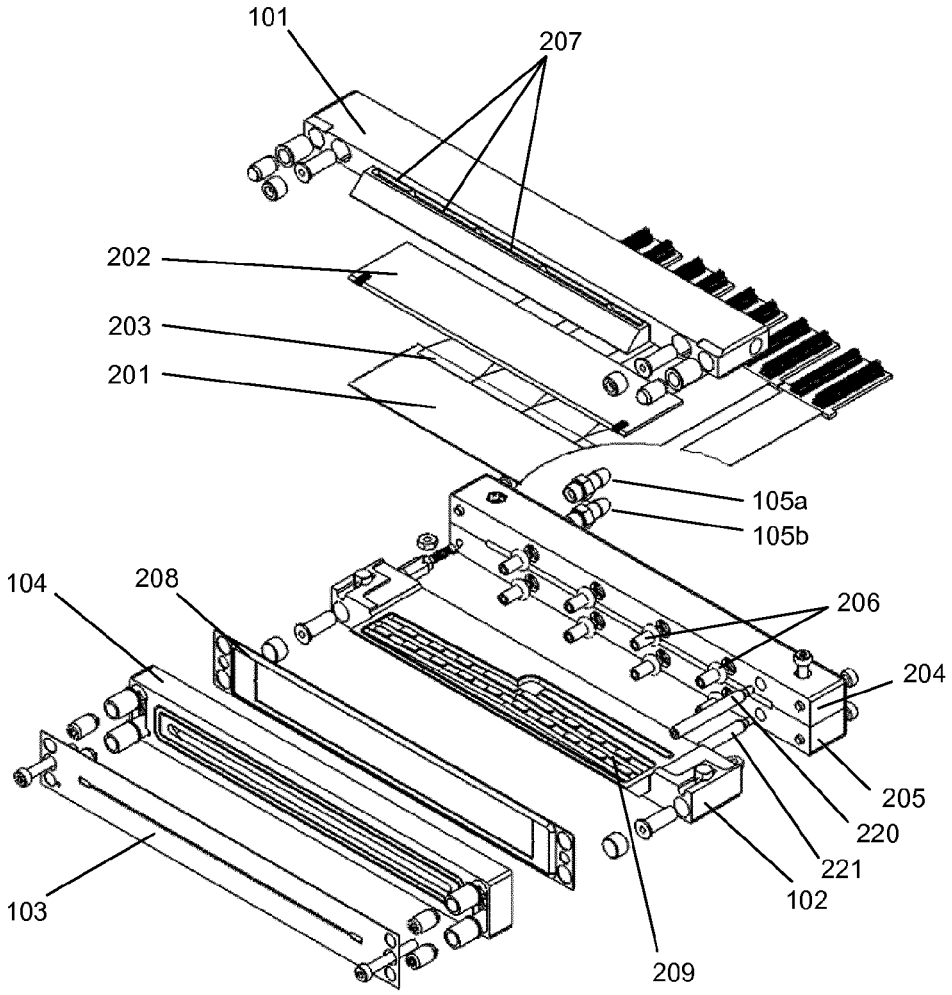
FIG. 2 is an exploded view of the printhead illustrated in FIG. 1.
Figure 5:
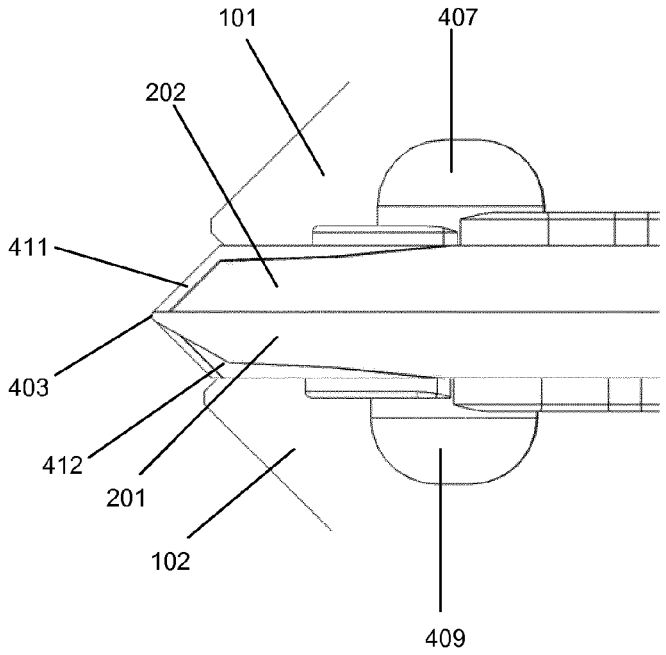
FIG. 5 is a detailed cross-sectional view of the ejection region of the printhead illustrated in FIG. 1
Figure 6:
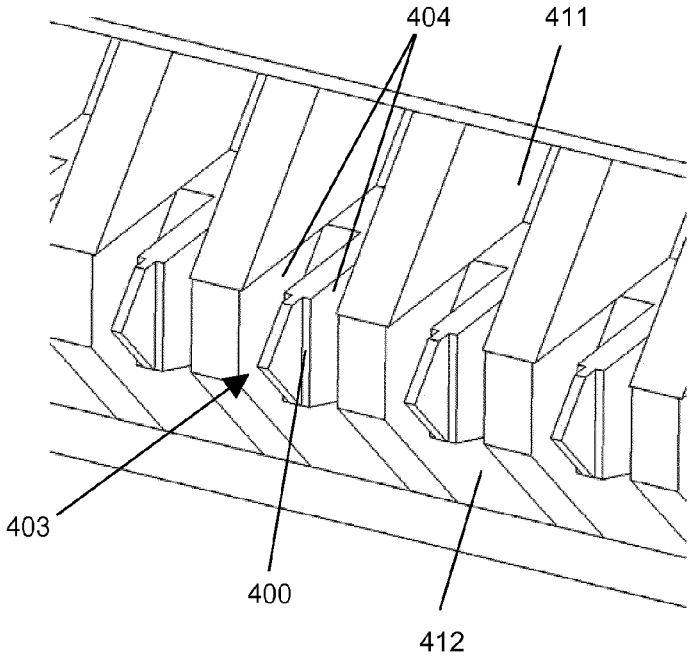
FIG. 6 is a three-dimensional close-up illustration of the ejection region of the printhead illustrated in FIG. 1

The printhead 100 of the present invention comprises a two-part main body consisting of an inflow block 101 and an outflow block 102, between which are located a prism 202 and a central tile 201, the latter having the ejector array formed along its front edge. At the front of the printhead, an intermediate electrode plate 103 is mounted on to a datum plate 104, which in turn is mounted onto the main body of the printhead. A gasket 208 is provided between the datum plate 104 and the inflow and outflow blocks.

Referring to FIGS. 2, 3, 4, 5 and 6, the main body of the printhead comprises the inflow block 101 and the outflow block 102, sandwiched between which are the prism 202 and the central tile 201. The central tile 201 has an array of ejection locations or tips 403 along its front edge and an array of electrical connections 203 along its rear edge. Each ejection location 403 comprises an upstand 400 with which an ink meniscus interacts (in a manner well known in the art). On either side of the upstand 400 is an ink channel 404 that carries ink past both sides of the ejection upstand 400. In use, a proportion of ink is ejected from the ejection locations 403 to form, for example, the pixels of a printed image. The ejection of ink from the ejection locations 403 by the application of electrostatic forces is well understood by those of skill in the art and will not be described further herein.

The prism 202 comprises a series of narrow channels 411, corresponding to each of the individual ejection locations 403 in the central tile 201. The ink channels of each ejection location 403 are in fluid communication with the respective channels of the prism 202, which are, in turn, in fluid communication with a front portion 407 of the inlet manifold formed in the inflow block 101 (said inlet manifold being formed on the underside of the inflow block 101 as it is presented in FIG. 2 and thus not shown in that view). On the other side of the ejection locations 403, the ink channels 404 merge into a single channel 412 per ejection location 403 and extend away from the ejection locations 403 on the underside (as drawn in FIG. 5) of the central tile 201 to a point where they become in fluid communication with a front portion 409 of the outlet manifold 209 formed in the outflow block 102.

The ink is supplied to the ejection locations 403 by means of an ink supply tube 220 in the printhead 100 which feeds ink into the inlet manifold within the inflow block 101. The ink passes through the inlet manifold and from there through the channels 411 of the prism 202 to the ejection locations 403 on the central tile 201. Surplus ink that is not ejected from the ejection locations 403 in use then flows along the ink channels 412 of the central tile 201 into the outlet manifold 209 in the outflow block 102. The ink leaves the outlet manifold 209 through an ink return tube 221 and passes back into the bulk ink supply.

The channels 411 of the prism 202 which are connected to the individual ejection locations 403 are supplied with ink from the inlet manifold at a precise pressure in order to maintain accurately controlled ejection characteristics at the individual ejection locations 403. The pressure of the ink supplied to each individual channel 411 of the prism 202 by the ink inlet manifold is equal across the entire width of the array of ejection locations 403 of the printhead 100. Similarly, the pressure of the ink returning from each individual channel 412 of the central tile 201 to the outlet manifold 209 is equal across the entire width of the array of ejection locations 403 and precisely controlled at the outlet, because the inlet and the outlet ink pressures together determine the quiescent pressure of ink at each ejection location 403.

The printhead 100 is also provided with an upper 204 and a lower 205 cleaning fluid manifold. The upper and lower cleaning fluid manifolds have respective inlets 105*a*, 105*b* through which rinse/cleaning fluid can be supplied to the printhead 100. The inflow 101 and outflow 102 blocks are both provided with cleaning fluid passages 401. The passages in the inflow block 101 are in fluid communication with upper cleaning fluid manifold 204 and those passages in the outflow block 102 are in fluid communication with the lower cleaning fluid manifold 205. Fluid connectors 206 link the cleaning fluid manifolds to the respective cleaning fluid passages.

The cleaning fluid passages 401 within the inflow and outflow blocks end at cleaning fluid outlets 207. The pathway to the ejection locations 403 continues along enclosed spaces 405 defined by the V-shaped cavity 402 in the datum plate 104 and the outer surfaces of the inflow 101 and outflow 102 blocks, until the point at which the ejection locations 403 themselves lie within the cavity 402. The two sides of the V-shaped cavity are, in this example, at 90 degrees to each other.

Figure 7:
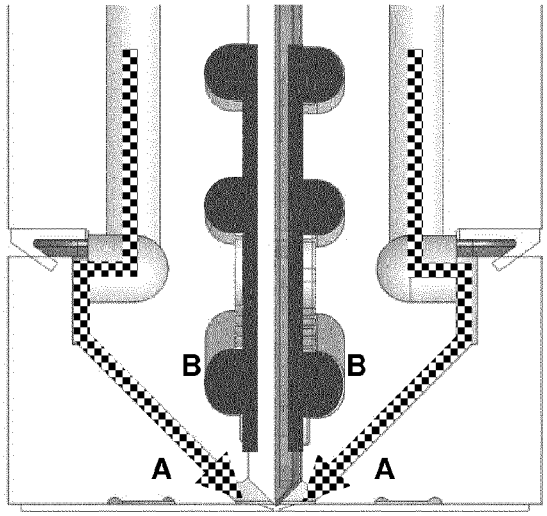
FIG. 7 is the same view as FIG. 4, but with fluid flow paths indicated.

As can be seen in FIG. 7, arrows A show the fluid pathways taken by the rinse/cleaning fluid and/or air during cleaning of the printhead. Regions B show the pathways taken by the ink through the inlet and outlet manifolds and along ink channels 411 and 412. During normal operation a flow of ink exists around the tips 403 from the inlet side (inlet block 201) to the outlet side (outflow block 202). In normal use, there is no flow of cleaning fluid—indeed no cleaning fluid is present in the printhead. However, during a cleaning operation, ink flow is stopped and the ink is withdrawn slightly from the tips to the position indicated above and in FIG. 7, as described below. This withdrawal of the ink means that, when cleaning fluid is supplied through passages 401 and into cavity 402, the cleaning fluid does not mix substantially with the ink in the printhead, but can clean the tips 403. When cleaning is complete, the printhead can be primed easily by moving the ink back to the ejection locations 403 so that it can resume a constant flow around the ejection locations 403 from the inflow to the outflow side of the printhead.

Figure 8:
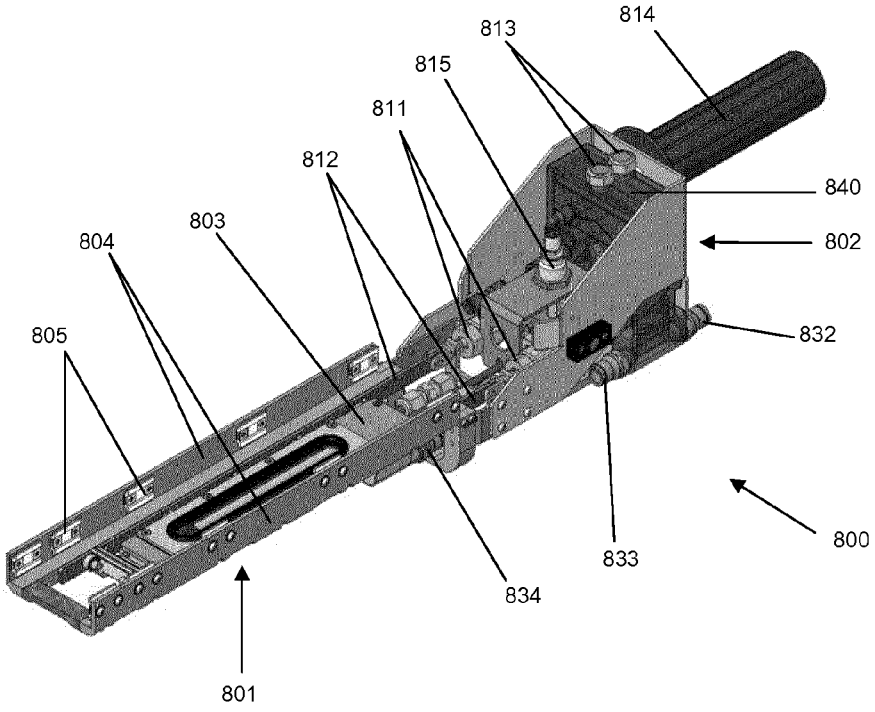
FIG. 8 shows one example of a maintenance cap for use in the cleaning method.
Figure 9:
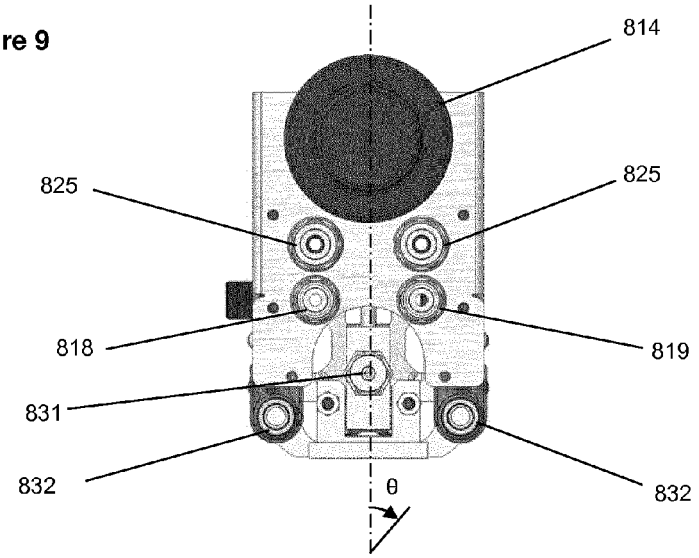
FIG. 9 shows an end view of the maintenance cap of FIG. 8, and the various fluid connections.
Figure 10:
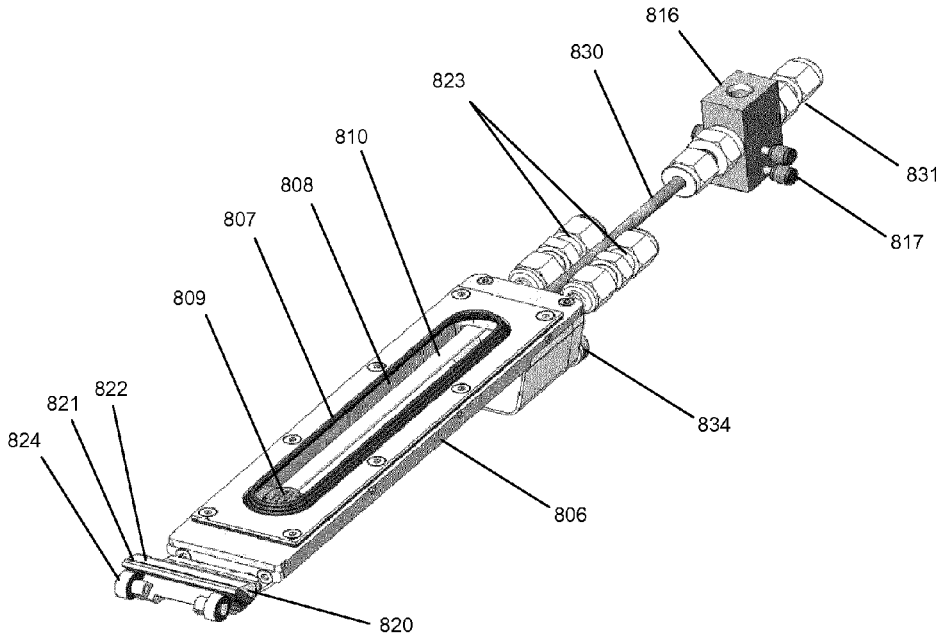
FIG. 10 shows a schematic view of some of the internal components of the maintenance cap.

An example of a maintenance cap that can be used during cleaning of the ejection tips is shown in FIGS. 8 to 10.

Figure 12:
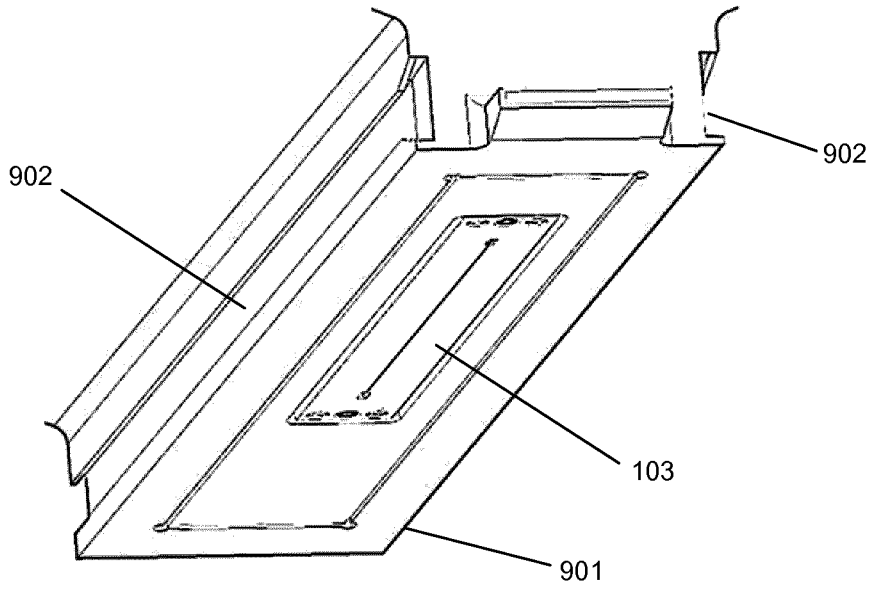
FIG. 12 shows an example of a printhead module outer casing with which the maintenance cap engages.

The maintenance cap 800 includes a printhead engaging section 801 and an engagement section 802, which in this example is a clamping engagement. The printhead engaging section 801 includes a base section 803 and upstanding side walls 804. The side walls include linear key way bearings 805 which engage with a corresponding profile 902 on a printhead module outer casing 901 (FIG. 12). The side walls could be replaced with, or used together with, other means of mounting the cap 800 on the printhead. This is especially true, if multiple printheads are provided and the same cap is used to cover more than one of the printheads at the same time. The cap may also provided with a fitting handle 814 to help with the initial installation of the cap in the printer (although thereafter the cap is controlled automatically).

The base section 803 includes a tank 806 on which a printhead seal 807 is mounted. The tank has an opening 808 into which, in use, rinse fluid is drained from the printhead through the slot in the IE 103, the opening defining a cavity within the tank 806. The opening 808 is surrounded by the seal 807. In the figures, the printhead to be cleaned is placed above the tank, in engagement with the seal 807. Beneath the seal 807, on the opposite side of the opening 808, a movable spray head 809 is provided, mounted on a pair of spray head guides 810 (one is visible in FIG. 10). The function of the spray head 809 is to clean the outer face of the IE 103 by directing fine jets of rinse fluid thereon.

Figure 11A:
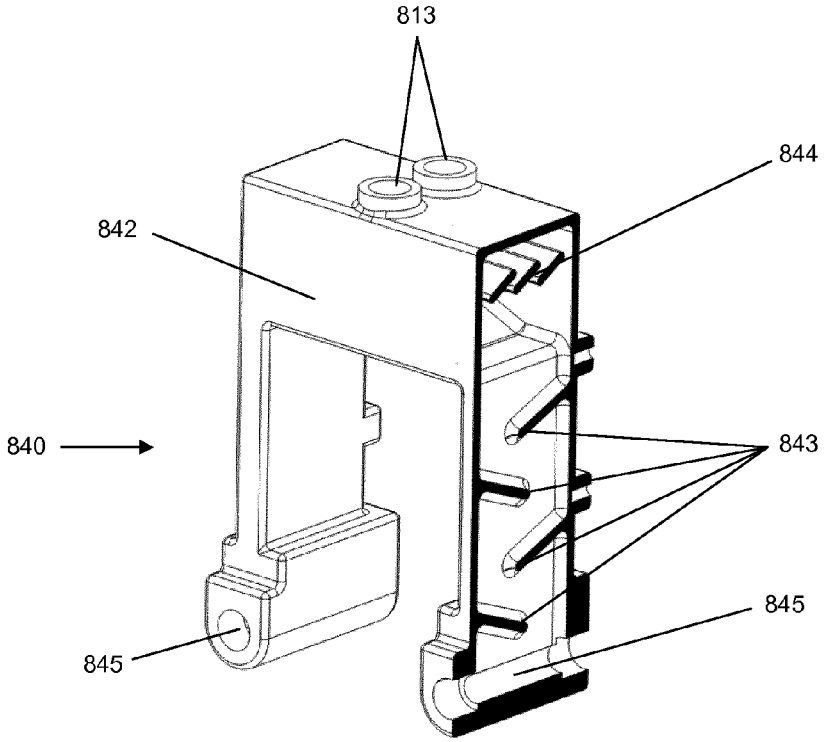
FIGS. 11A and 11B show one arrangement of baffles in the venting system on the maintenance cap.
Figure 11B:
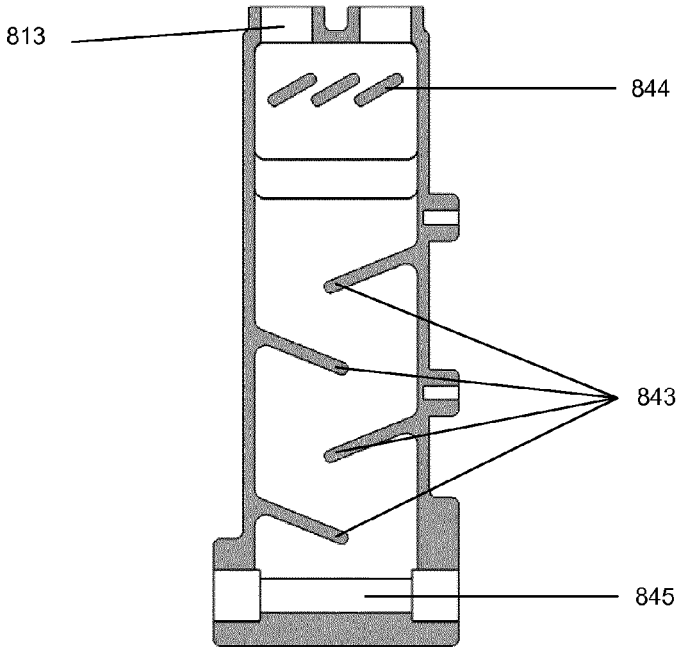

In operation, the maintenance cap is inserted across the front of the printhead and clamped or otherwise fastened against the outer face of the intermediate electrode forming a fluid-tight seal. The printhead ink pathways remain filled with ink during the cleaning process, except for the very tip region as the ink is caused to retreat from tips by a pressure differential at the tips. The cleaning action is therefore confined to the tip-IE region of the printhead. The cap collects and drains rinse fluid from the printhead during a cleaning operation, the fluid preferably being drained to a tank in the fluid management system remote from and lower than the printhead. Because of the seal, the draining action from the maintenance cap could create a partial vacuum in the maintenance cap that would draw the ink out of the printhead. A further preferred feature is a baffled venting system, see FIG. 11, which can prevent this. The system includes one or more, in this case two, air vents 813, and these vents allow equalisation of air pressure between the inside of the maintenance cap and the surrounding atmosphere, and prevents the escape of rinse fluid through the vent by incorporating a series of baffles 843, 844.

The maintenance cap, in a preferred embodiment, has a pneumatically actuated clamp to clamp to the face of the intermediate electrode. This is preferably achieved using a pair of bidirectional pin cylinder actuators 811 acting directly on a pair of cam strips 812, which are moved, longitudinally in this example, to cause the upward clamping motion of the maintenance cap base section 803 to the printhead. The cylinders 811 are pneumatically driven in parallel from switched compressed air sources that connect to two pneumatic connectors respectively as shown in FIG. 9: seal-unclamp 818 and seal-clamp 819.

When sealed to the printhead, it is important that no attempt is made to withdraw the cap, causing it to rub across the printhead, potentially damaging the seal, the drive, or the printhead itself. Similarly the cap must not be inserted across the face of the printhead while in a clamped state. To guard against these eventualities, the coupling of the cap to a linear drive mechanism (not shown) that inserts and withdraws the cap is preferably interlocked to the clamp state of the cap, by use of a third pneumatic pin cylinder 815 that may be fed from the same switched compressed air source as the cylinders 811 that actuate the clamping mechanism. The cylinder 815 engages the drive with the cap when the cap is unclamped and disengages it when clamped, thereby interlocking the cap drive to the clamp state. In the example shown, the linear drive mechanism is continuously engaged with the drive engagement block 816 via four drive engagement pins 817, which locate in the moving part of the linear drive mechanism. When actuated, the pin of the cylinder 815 locates into the socket of the drive engagement block 816. In this state, the entire maintenance cap is coupled to the linear drive for insertion and withdrawal under the printhead. The switched compressed air source that actuates the cylinder 815 is the same source that actuates the unclamped state of the clamping cylinders 811, these all being linked by pneumatic tubing to the seal-unclamp pneumatic connector 818. Hence, when the unclamped state is actuated, the linear drive mechanism engages with the entire cap assembly.

When in the clamped state, the linear drive mechanism engages with the moveable spray head 809 only. The spray head 809 is moveable along the length of the opening 808, its motion guided centrally by the guides 810. Rinse fluid is supplied to the spray head via a rigid tube 830 that connects the spray head with the spray head connection 831. The tube 830 also mechanically couples the spray head 809 to the drive engagement block 816, the tube 830 passing through an O-ring seal in the tank wall that allows movement of the tube through the seal without losing fluid from the tank 806. When in the clamped state, the spray head 809 may thereby be moved along the length of the printhead spraying rinse, air, or a mixture thereof, when required by the cleaning operation.

Vacuum Wiper

In a preferred embodiment a vacuum wiper 820 is located at one end of the base section 803. The vacuum wiper 820 comprises a narrow slot 821 in the upper face of a wiper body 822 which is in fluid communication via a pair of tubes 810 (rigid tubes that also act as the spray head guides in this example) and connectors 823 to a pair of vacuum wiper connections 825 via short lengths of flexible tubing (not shown). The wiper body is pivoted at its point of attachment to the base section 803 and is sprung upwards towards the printhead. Two rollers 824 attached to the wiper body 822 roll against the face of the printhead several millimeters either side of the ejection region as the maintenance cap is inserted or withdrawn, the rollers serving to control the spacing between the wiper slot and the face of the IE to approximately 0.2 mm. When the connections 825 are connected to a source of vacuum, air is drawn into the slot 821. Applying vacuum in this way as the maintenance cap is withdrawn from the printhead after a cleaning operation draws any drips or residual rinse fluid from the face of the IE into the wiper and may be used to dry the outer face of the IE. It has been found to be more effective at drying the IE than a conventional wiper because the vacuum will draw fluid out of the slot between the two blades of the IE more effectively. The vacuum wiper described above also has no rubbing contact with the IE, and therefore minimises the risk of wearing or otherwise damaging the precision IE component, or of pushing foreign material into the IE slot.

Baffle System

Fluid that enters the tank 806 is drained from one or both cap drain connectors 832. The provision of two cap drains allows the cap to be employed on printheads mounted in a variety of orientations, in each case the lower of the two drains is used and the upper one is plugged. The cap drain connectors 832 are mounted in a baffled venting block 840, which allows equalisation of air pressure between the inside of the maintenance cap and the surrounding atmosphere while preventing the escape of rinse fluid through the vents 813 by incorporating a series of internal baffles 843, 844. The venting block comprises a hollow body 842 with two downward projecting sections, one on each side. Each of these has at its base a channel 845 that carries rinse fluid that drains from the cap back to a tank in the remote fluid management system. The channels 845 are open to the hollow interior of the venting block within which a series of downward-sloping baffles 843, 844 inhibit the passage of rinse up through the body 842 from splashing, etc, while allowing air to pass between the vents 813 and the channels 845. The combination of rinse and air used in the printhead cleaning process is such that the flow of rinse from the tank 806 to the venting block 840 along short tubes (not shown) connecting the tank drains 834 to the venting block inlets 833 is discontinuous, allowing sufficient passage of air between the venting block 840 and the tank 806 to maintain pressure in the tank 806 close to that of the surrounding atmosphere. Furthermore, when the printhead and cap are operated in an orientation other than vertical, the higher of the two channels 845 will generally be free of rinse and will serve as a continuous air connection with the tank 806 to maintain atmospheric pressure therein.

The maintenance cap described above is capable of operating vertically as depicted in FIGS. 8 to 10 or at any angle θ as indicated in FIG. 9 of up to ±75 degrees from vertical, and so is suitable for use in printing machines in which the printheads are mounted in this range of orientations.

Figure 13:
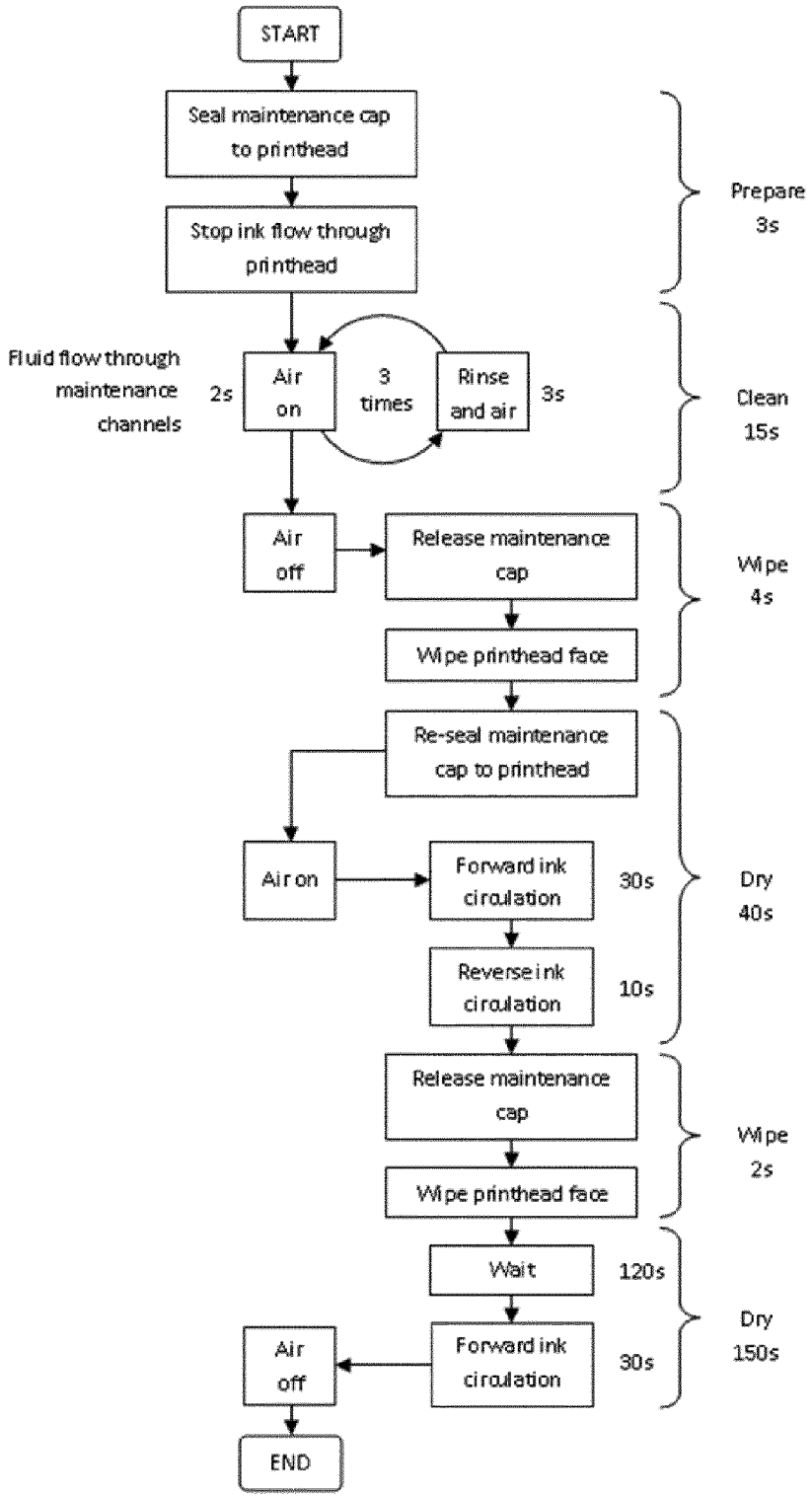
FIG. 13 is a flow chart describing the stages of the cleaning process.

Description of the one example of the cleaning process is shown in FIG. 13 and is described as follows:

1. START: When a printhead cleaning operation is called for, either through automatic scheduling or operator intervention, printing is stopped, the printhead moved away from the substrate (or the substrate moved depending on the type of printer), and a maintenance cap, such as that described in FIGS. 8 to 10, presented to the face of the printhead.

2. The maintenance cap is sealed to the face of the printhead.

3. Ink flow around the printhead—a constant feature of the printhead in its normal operating state, controlled by difference in ink pressures between the inlet and outlet ports of the printhead—is stopped by setting equal pressures at the inlet and outlet ports, at the mid-point of the normal operating pressures.

4. Air under slight positive pressure is supplied to the cleaning fluid inlets 105*a* and 105*b* via an external control valve. The air passes through the upper and lower cleaning fluid manifolds 204, 205, where it is distributed via fluid connectors 206 to eight passages 401 spaced evenly across the width of the printhead: four on the upper side and four on the lower side. It emerges from cleaning fluid outlets 207 into the cavity 402 near the front of the printhead in close proximity to the ejection tips 403 and the inner face of the intermediate electrode 103. The air pressure near the tips is slightly higher than that of the atmosphere external to the printhead or in the maintenance cap because the narrow slot in the IE presents a restriction to the flow of air out of the printhead. The higher air pressure is not sufficient to force the ink backwards out of the printhead, but causes it to retreat from the tip region enough to expose the ejection tips 403.

5. A rinse-air mixture is periodically directed through the cleaning fluid passages 401 in short bursts, controlled via an external control valve. Typical timings are: air 2 s; rinse & air 3 s; air 2 s; rinse & air 3 s; air 2 s; rinse & air 3 s; air 2 s. The timings have been found to provide effective cleaning whilst minimising the amount of rinse that enters the ink channels. Rinse fluid flows from the cavity 402 through the open slot in the centre of the intermediate electrode 103 into the maintenance cap from where it is drained.

6. Air is turned off and the maintenance cap released, allowing a wiper to be drawn across the outside face of the intermediate electrode 103 to remove any drips. The cap is re-sealed to the printhead.

7. The air supply is turned on again to start drying the internal faces of the printhead. Air flows through the spaces 405 and the cavity 402 and into the maintenance cap from where it is vented.

8. Ink flow around the printhead is re-established by raising the ink pressures to bring the ink forwards to the tips again and setting a pressure difference between the inlet and outlet ports of the printhead. Flow is established in the forward direction (inlet to outlet) for 30 s, then reversed by swapping the pressures at the inlet and outlet ports, which has the effect of expelling any air trapped in the ink channels from the cleaning process.

9. In this state, the maintenance cap is released again and the outside face of the intermediate electrode wiped again to remove residual drips of rinse, and the maintenance cap withdrawn completely from the printhead.

10. There follows a further drying phase of 150 s in total, after 120 s of which the ink flow is restored to the forward direction. The air is then turned off.

11. The pressures are controlled such that the ink pressure at the tips is just below that of the atmosphere surrounding the tips so that the ink flow is confined in the channels 404 each side of the ejection tips and the ink meniscus pins to the tips and edges of the channels 404.

12. END

The whole sequence is complete in under 5 minutes, around a quarter that of earlier methods.

It will be appreciated that many of the steps described above are not essential to the invention as described—indeed, the present invention is defined in the broadest terms by the claims filed herewith.

The invention claimed is:

1. A printhead maintenance cap for attachment to a printhead, the cap comprising:

a main body defining a chamber into which rinse fluid passes from the printhead during a cleaning cycle;

a seal for engagement with the printhead prior to a cleaning cycle starting; and a venting system for equalising the pressure in the chamber and the surrounding atmosphere;

wherein the venting system includes one or more baffles which are configured to allow equalising of pressure in the chamber and the surrounding atmosphere while preventing the escape of rinse fluid through the venting system.

2. A printhead maintenance cap according to claim 1, further comprising means for, in use, bringing the seal into engagement with the printhead.

3. A printhead maintenance cap according to claim 1, wherein the engagement means includes a clamp and/or a pneumatically operated mechanism.

4. A printhead maintenance cap according to claim 1, wherein the one or more baffles are formed from a single piece component.

5. A printhead maintenance cap according to claim 1, further comprising one or more drains for draining fluid from the cap in use.

6. A printhead maintenance cap according to claim 1, further comprising one or more additional seals to permit the cap to be used with a multi-head printhead.

7. A printhead maintenance cap according to claim 1, further comprising a movable spray head for providing one or more jets of rinse fluid within the cap.

8. A printhead maintenance cap according to claim 1, further comprising a drive mechanism for moving the cap into and out of engagement with the printhead.

9. A printhead maintenance cap according to claim 8, further comprising an interlock for preventing movement of the cap when in a sealed engagement with the printhead.

10. A printhead maintenance cap according to claim 1, further comprising a vacuum wiper.

11. A printhead maintenance cap according to claim 10, wherein the vacuum wiper is pivotable relative to the cap main body.

12. A printhead maintenance cap according to claim 11, wherein the vacuum wiper is biased towards the intended location of the printhead.

13. An electrostatic printhead having a plurality of ejection tips and an intermediate electrode, the printhead further comprising a maintenance cap according to claim 1.

14. A printhead according to claim 13 further comprising an interlock for preventing movement of the cap when in a sealed engagement with the printhead, wherein the vacuum wiper does not contact the intermediate electrode.

* * * * *